US005599358A

United States Patent [19]

Giavazzi et al.

[11] Patent Number: 5,599,358

[45] Date of Patent: Feb. 4, 1997

[54] GAS OIL COMPOSITION

[75] Inventors: Fulvio Giavazzi, San Giuliano Milanese; Febronio Panarello, Carugate, both of Italy

[73] Assignee: Euron S.p.A., Milan, Italy

[21] Appl. No.: 573,875

[22] Filed: Dec. 18, 1995

Related U.S. Application Data

[63] Continuation of Ser. No. 274,620, Jul. 13, 1994, abandoned.

[30] Foreign Application Priority Data

Jul. 21, 1993 [IT] Italy ..... MI93A1611

[51] Int. Cl.[6] ..... C10L 1/18

[52] U.S. Cl. ..... 44/388; 44/401; 44/402

[58] Field of Search ..... 44/401, 402, 388

[56] References Cited

U.S. PATENT DOCUMENTS

| | | | |
|---|---|---|---|
| 1,423,049 | 7/1922 | Tunison | 44/401 |
| 2,081,176 | 5/1919 | Hewlett | 44/401 |
| 3,039,956 | 6/1962 | Fareri et al. | 44/388 |
| 4,244,829 | 1/1981 | Coupland et al. . | |
| 4,364,743 | 12/1982 | Erner | 44/388 |
| 4,695,411 | 9/1987 | Stenn et al. | 44/388 |
| 4,920,691 | 5/1990 | Fainman . | |

FOREIGN PATENT DOCUMENTS

| | | |
|---|---|---|
| 0102425 | 3/1984 | European Pat. Off. . |
| 735777 | 8/1955 | United Kingdom . |
| 859259 | 1/1961 | United Kingdom . |
| 2090611 | 7/1982 | United Kingdom . |
| 2099449 | 12/1982 | United Kingdom . |
| 2158457 | 11/1985 | United Kingdom . |

*Primary Examiner*—Margaret Medley
*Attorney, Agent, or Firm*—Oblon, Spivak, McClelland, Maier & Neustadt, P.C.

[57] ABSTRACT

A gas oil composition for motor vehicles, with a sulfur content lower than 0.2% by weight and with a content of aromatic hydrocarbons lower than about 30% by weight, contains, as a lubricity improver agent, an amount of from 100 to 10,000 ppm (parts per million parts by weight) of lower ($C_1$–$C_5$) alkyl esters of a mixture of saturated and unsaturated $C_{12}$–$C_{22}$ fatty acids, derived from vegetable oleaginous seeds.

7 Claims, No Drawings

GAS OIL COMPOSITION

This application is a Continuation of application Ser. No. 08/274,620, filed on Jul. 13, 1994, now abandoned.

The present invention relates to a gas oil composition for motor vehicles (diesel fuel), with a low sulfur content, containing a lubricity improver agent.

Sulfur contained in gas oils (diesel fuels) constitutes a particularly serious environmental problem. New regulations have been discussed for long time at EC level, following other regulations, already adopted in such geographical regions as California and Sweden, which considerably limit the sulfur and, aromatics contents in gas oil, which are thought to contribute to the emissions of polluting substances ($SO_x$, $NO_x$, particulates and smoke) in diesel engine exhaust gases.

Since 1985 Laws have been passed in California which limit to 0.05% by weight the allowed sulfur level in gas oil. Subsequently, in November 1990, EPA (Environmental Protection Agency), accordance with EMA (Engine Manufactures Associations), API (American Petroleum Institute) and NCFC (National Coalition of Farm Cooperatives), passed Laws applicable throughout the whole territory of the United States, which set limits both to sulfur content and to aromatics content in gas oil (maximal allowed level 35% by volume). Such regulations went into effect in October 1991.

Owing to a more deteriorated environmental situation, in California stricter regulations were passed by CARB (California Air Resources Board), which limit the aromatics content in gas oil to 10% by volume (for large size refineries with a production capacity of 50.000 DBP) and to 20% (for small size refineries). These regulations went into effect on Oct. 1st, 1993. These regulations should allow the newly manufactured diesel engines to limit the particulates emissions to 0.10 g/bhph, versus the presently allowed threshold value of 0.25 g/bhph.

As regards the European Countries, Sweden passed regulations which, through strong tax relief policies, stimulate the production of ecological gas oils. For example, for metropolitan Stockholm area, gas oils have been subdivided into the following classes:

| Gas oil type | Total Aromatics Content | Polynuclear Aromatics Content | Sulfur | Tax Relief |
|---|---|---|---|---|
| Class 1 | <5% v | <0.1% v | <10 ppm | 35% |
| Class 2 | <20% v | <1% v | <50 ppm | 15% |
| Class 3 | <25% v | — | <500 ppm | 0% |

As regards the European Economic Community, only a short time ago regulations were passed and turned into effect, which limit the sulfur content in gas oils at no more than 0.2% by weight, and stricter regulations are being discussed at present, which should go into effect inuring from 1996. Such regulations should provide for sulfur level to be limited at 0.05% by weight, besides limiting the aromatics contents.

Waiting for stricter regulations, Italy, by means of a Ministry Decree, rendered mandatory, inuring from 1992, using, in metropolitan areas, gas oils containing 0.1% by weight of sulfur.

The decrease in sulfur and aromatics levels in gas oils is technically obtained by means of refining treatments, in particular by catalytic hydrogenation. However, it was observed that decreasing sulfur and aromatics levels in gas oils causes problems of damage of injection system components in diesel engines which are due to the decreased lubricity of the fuel. In particular, it was observed that gas oils with sulfur content equal to, or higher than, 0.2% by weight and an aromatics level of the order of 30% by weight do not cause any particular lubricity problems. However, when sulfur level decreases down to lower values than 0.2% by weight, and the aromatics level decreases down to lower values than 30% by weight, phenomena of wear of the injection pumps, in particular of rotary pumps and of pump injectors, arise with a proportionally increasing intensity. So, e.g., using Swedish gas oils of the above reported classes 1 and 2 causes the failure of a rotary pump of light-duty engines (i.e., car engines) after an average distance covered of about 10,000 kin. In low-sulfur, low-aromatics gas oils, the gas oil capability is in fact lost or, at least, decreased, of supplying a proper lubrication, i.e., the capability of forming a film capable of keeping the surfaces of the mechanical components separated from each other during their movement relative to each other. Such a capability, referred to as "lubricity", also depends on the geometry and composition of the lubricated components and on the operating conditions.

In the art, the use is known of gas oil additives, usually understood as anti-wear agents, of the types of fatty acid esters, unsaturated dimerized fatty acids, primary aliphatic amines, fatty acid amides of diethanolamide and long-chain aliphatic monocarboxy acids, such as disclosed, e.g., in U.S. Pat. Nos. 2,252,889; 4,185,594; 4,208,190; 4,204,48 and 4,428,182. Most of them are additives which display their desired characteristics within a range of relatively high concentrations, a feature which i s particularly undesired, also on considering their costs. In U.S. Pat. No. 4,609,376, anti-wear additives are disclosed, which are formed by esters of monocarboxy or polycarboxy acids and polyhydroxy alcohols. These additives are useful in alcohol containing fuels.

The present Applicant has now found, according to the present invention, that a particular class of alkyl esters of higher fatty acids of natural origin, generally formed by straight-chain, mono- or poly-unsaturated acids, are lubricity improver additives which are highly effective in gas oils with low sulfur and aromatics contents. In particular, these types of esters are available as that product which is known on the market with the name "bio-diesel", which is basically constituted by a blend of methyl esters of fatty acids of vegetable origin. Bio-diesel, which was proposed for use as a low polluting diesel fuel, is a commercially available product and constitutes a very cheap additive, as compared to the additives known from the prior art, and is effective within a range of low concentrations in said gas oils.

In accordance therewith, the present invention relates to a gas oil composition (diesel fuel), with a sulfur content equal to, or lower than, 0.2% by weight and with a content of aromatic hydrocarbons lower than about 30% by weight, characterized in that said composition contains, as a lubricity improver agent, an amount comprised within the range of from 100 to 10,000 ppm (parts per million parts by weight) of lower alkyl esters of a mixture of saturated and unsaturated, straight-chain fatty acids, of from $C_{12}$ to $C_{22}$ carbon atoms, derived from vegetable or oleaginous seeds.

According to the present invention, the expression "lower alkyl esters" means $C_1$–$C_5$ esters, in particular methyl and ethyl esters, with the methyl ester being preferred.

As already briefly mentioned hereinabove, the methyl esters of the saturated, mono- and poly-unsaturated, $C_{16}$–$C_{22}$, fatty acids, mixed with each other, are known on the market as "bio-diesel" or "rapeseed methyl ester" (RME), according to their origin, and where proposed in the past for use as low polluting diesel fuels.

Bio-diesel is normally obtained by starting from oleaginous seeds, in particular from rapeseed, sunflower and soy bean seeds. Said seeds are submitted to grinding and/or solvent extraction treatments (e.g., with n-hexane) in order to extract the oil, which is essentially constituted by triglycerides of saturated and unsaturated (mono- and poly-unsaturated, in mixture with each other, in proportions depending on the selected oleaginous seed), $C_{16}$–$C_{22}$, fatty acids. Said oil is submitted to a filtration and refining process, in order to remove any possible free fats and phospholipids present, and is finally submitted to a trans-esterification reaction with methanol order to prepare the methyl esters of the fatty acids, which constitute bio-diesel.

Typical physical characteristics of a bio-diesel are the following:

| | |
|---|---|
| density (15° C.) | 0.84/0.90 g/ml |
| initial distillation point | min. 300° C. |
| end distillation point | max. 400° C. |
| flash point | min. 100° C. |
| sulfur content | <0.01% by weight |
| viscosity (38.7° C.) | 3.5/5 cSt |

A typical elemental analysis of a bio-diesel yields the following results: carbon 77%; hydrogen 12%; and oxygen 11% by weight.

A typical composition of a bio-diesel derived from rape seed oil contains the methyl esters of the following $C_{16}$–$C_{18}$ fatty acids at the following per cent by weight levels:

5% palmitic acid (hexadecanoic or cetyl acid)

$CH_3(CH_2)_{14}COOH$

2% stearic acid (octadecanoic acid)

$CH_3(CH_2)_{16}COOH$

63% oleic acid (cis-octadecenoic acid)

$CH_3(CH_2)_7CH{:}CH(CH_2)_7COOH$

20% linoleic acid $CH_3(CH_2)_4CH{:}CHCH_2CH{:}CH(CH_2)_7COOH$

9% linolenic acid (9,12,15-octadecatrienoic acid)

$CH_3CH_2CH{:}CHCH_2CH{:}CHCH_2CH{:}CH(CH_2)_7COOH$

1% octadecatetraenoic acid

A typical composition of bio-diesel derived from sunflower oil, contains the methyl esters of the following $C_{16}$–$C_{22}$ fatty acids, as weight per cent values:

8% palmitic acid (hexadecanoic or cetyl acid)

$CH_3(CH_2)_{14}COOH$ 0.5% arachic acid (eicosanoic acid)

$CH_3(CH_2)_{18}COOH$ 0.2% behenic acid (docosanoic acid)

$CH_3(CH_2)_{20}COOH$

20% oleic acid (cis-octadecenoic acid)

$CH_3(CH_2)_7CH{:}CH(CH_2)_7COOH$ 67.7% linoleic acid $CH_3(CH_2)_4CH{:}CHCH_2CH{:}CH(CH_2)_7COOH$ 0.5% linolenic acid (9,12,15-octadecatrienoic acid)

$CH_3CH_2CH{:}CHCH_2CH{:}CHCH_2CH{:}CH(CH_2)_7COOH$

1 % octadecatetraenoic acid.

A typical composition of bio-diesel derived from soy bean oil contains the methyl esters of the following $C_{16}$–$C_{19}$ fatty acids, as weight per cent values:

0.5% lauric acid $CH_3(CH_2)_{10}COOH$ 0.5% miristic acid $CH_3(CH_2)_{12}COOH$

12% heptadecanoic acid $CH_3(CH_2)_{15}COOH$

4% nonadecanoic acid $CH_3(CH_2)_{17}COOH$

25% oleic acid (cis-octadecenoic acid)

$CH_3(CH_2)_7CH{:}CH(CH_2)_7COOH$

52% linoleic acid $CH_3(CH_2)_4CH{:}CHCH_2CH{:}CH(CH_2)_7COOH$

6% linolenic acid (9,12,15-octadecatrienoic acid)

$CH_3CH_2CH{:}CHCH_2CH{:}CHCH_2CH{:}CH(CH_2)_7COOH$

Of course, the higher alkyl esters of the above listed aliphatic carboxy acids, containing up to 5 carbon atoms in their alkyl moiety, can be used, although the methyl esters constitute the lubricity improver agents for low-sulfur, low-aromatics gas oils.

Therefore, the lubricity improver agent for diesel fuel, according to the present invention, is constituted by a mixture of lower alkyl esters, and preferably methyl esters, of a mixture of fatty acids with a $C_{12}$–$C_{22}$ straight chain, mainly with an even number of carbon atoms in their molecule, which mixture contains from 5 to 20% by weight of saturated fatty acids, from 70 to 95% by weight of total mono-unsaturated and di-unsaturated fatty acids, and from 0 to 10% by weight of total tri-unsaturated and tetra-unsaturated fatty acids.

The most important saturated fatty acids, present in bio-diesel as their methyl esters, are: lauric acid, palmitic acid and stearic acid. The most important unsaturated fatty acids, present in bio-diesel as their methyl esters, are: oleic acid, linoleic acid and linolenic acid.

Therefore, the lubricity improver agent, according to the present invention, will have a composition as indicated hereinabove, in which the saturated acids are constituted by one or more from among lauric acid, palmitic acid and stearic acid; the mono-unsaturated acids are essentially constituted by oleic acid, the di-unsaturated acids by linoleic acid and the tri-unsaturated acids by linolenic acid.

The lubricity improver agent will be applied to gas oils with a sulfur content lower than 0.2% by weight and preferably with a sulfur content lower than 0.1% by weight, up to reach sulfur-free, or essentially sulfur-free, gas oils, such as, e.g., gas oils containing 10 ppm, or less, of sulfur (corresponding to class 1 of Swedish gas oils, as reported hereinabove).

The concentration of the lubricity improver agent used in the compositions according to the present invention, will depend on sulfur concentration in gas oil, and, the lower the sulfur content, the higher, however within the above reported range, such a concentration will be. The present Applicant found anyway that, usually, an amount of improver agent of the order of 200–1,000 ppm is normally large enough in order to restore the desired lubricity, or even improve it, in gas oils containing 0.1–0.05% by weight thereof.

The gas oils which can be used according to the present invention, are gas oils for motor vehicles of petroleum origin, or gas oils produced by synthesis, or they are gas oils containing up to about 10% by volume of oxygen containing compounds, in particular of ether character, having, in any cases, a sulfur content equal to, or lower than, 0.2% by weight, and an aromatics content lower than 30% by weight.

Preferably, gas oils of petroleum origin are used, possibly admixed with usual additives, such as cetane number improvers, and agents which improve the low temperature properties of gas oil (e.g., pour point improvers, cloud point improvers and freezing point improvers). Typical specifications for gas oils are reported in the following table.

| GAS OIL | A | B | C | D | E |
|---|---|---|---|---|---|
| Density 15° C., g/ml | 0.81/0.86 | 0.82/0.86 | 0.82/0.86 | 0.80/0.82 | 0.80/0.82 |
| Distillate at 150° C., % by vol. | max 2 | max 2 | — | — | — |
| Distillate at 250° C., % by vol. | 25/<65 | 25/<65 | — | — | — |
| Distillate at 350° C., % by vol. | min 85 | min 85 | min 90 | 100 | 100 |
| Flash point, °C. | min 55 | min 85 | — | — | — |
| Sulfur, % by weight | max 0.2 | max 0.1 | max 0.05 | max 0.005 | max 0.001 |
| Cetane number | min 50 | min 50 | — | min 47 | — |
| Viscosity at 37.8° C., cSt | 2/5.35 | 2/5.35 | — | — | — |
| Total aromatics, % by vol. | — | — | — | max 20 | max 5 |
| Polynuclear aromatics, % by vol. | — | — | — | max 1 | max 0.1 |

Gas oil "A" is a typical EEC 1993 gas oil. Owing to its sulfur contents, normally the above mentioned lubricity problems do not exist. Gas oil "B" is a typical non-polluting EEC 1993 gas oil. Gas oil "C" is an EEC-gas oil contemplated by the regulations due to be passed inuring from 1996, having a composition falling within the Swedish class 3 of gas oils, as reported hereinabove. Gas oils "D" and "E" are gas oils falling within the scope of Swedish classes 2 and 1 for gas oils, as reported hereinabove. The gas oils of classes from to "E", display lubricity problems and therefore are suitable for use in the compositions according to the present invention.

The compositions according to the present invention can be prepared by simply adding the lubricity improver agent to the selected gas oil. For the sake of use convenience, preparing and adding to gas oil concentrated solutions, e.g. containing 50% by weight of said improver agent in a liquid hydrocarbon solvent, which may advantageously be constituted by the same gas oil, may be convenient.

The lubricity of gas oils is determined according to the method proposed by LUCAS CAV Ltd., and derives from the standard ASTM method D 2783 used for evaluating the lubricity of lubricant oils. More particularly, the method is carried out by using the Four-ball E.P. Tribological Tester, which is capable of measuring lubricity in terms of load carrying capacity (L.C.C.), which expresses the maximal pressure under which the lubricating film, formed by the fuel, is capable of retaining such lubricity properties deep roughening and surface seizure (scuffing) from taking place. The tester consists of four balls of ½-inch of diameter, wherein three of them, pressed against each other, remain in stationary state inside the "ball-pot", with the centre of each of said balls being on a same horizontal plane and said balls being equidistant from the revolutionary tester axis. The fourth ball is above said three balls, and is mounted on a rotating chuck and is into lubrified contact with the underlying three balls, which cannot rotate. The machine load is supplied through a lever and weight system to the ball pot, i.e., to the three stationary balls, which are urged against the fourth, upper ball (therefore, the load is applied from bottom upwards). The contact (sliding) surface between the bottom balls and the fourth, upper ball, is always the same; on the three lower balls, a wear scar is formed, the diameter of which depends on the following variables: applied load (kg), fourth ball revolution speed (revolutions per minute), contact test time (seconds) and, of course, on the characteristics of the lubricant used. The size of the wear scar is measured under the microscope.

In the present testing, the following parameters were used:

contact time per each single load=10 seconds;

revolution speed of the fourth ball=1420 revolutions per minute;

measurement of wear scar diameter=under microscope (accuracy ±0.001 mm).

Sequential tests with higher and higher load values were carried out with new balls and the machine load was increased by a factor of 1.26 relatively to the lower load used in the preceding tests. The load was increased until a sudden decrease in end contact pressure (L.C.C.) was obtained, which is calculated by means of the following relationship:

$$P=0.52L/d^2$$

wherein:

P is the end contact pressure expressed as $kg/mm^2$, d is the diameter of the wear scar (mm) and L is the machine load (kg).

The load carrying capacity (L.C.C.) of a fuel is the maximal value of contact pressure which was obtained from a test series with increasing loads.

The following gas oils were tested:

(I) Gas oil "A" containing 0.2% by weight of sulfur (reference gas oil);

(II) Gas oil "B" containing 0.1% by weight of sulfur (comparison gas oil);

(III) Gas oil "C" containing 0.05% by weight of sulfur (comparison gas oil);

(IV) Gas oil "C" containing 0.05% by weight of sulfur and admixed with 500 ppm of bio-diesel from sunflower, having the composition as reported in the disclosure;

(V) Gas oil "C" containing 0.05% by weight of sulfur and admixed with 1,000 ppm of bio-diesel from sunflower, having the composition as reported in the disclosure;

(VI) Gas oil "C" containing 0.05% by weight of sulfur and admixed with 10,000 ppm of bio-diesel from sunflower, having the composition as reported in the disclosure;

(VII) Low-polluting gas oil containing less than 0.1% by weight of sulfur (comparison gas oil);

(VIII) Low-polluting gas oil containing less than 0.1% by weight of sulfur (VII) admixed with 1,000 ppm of bio-diesel from sunflower having the composition as reported in the disclosure.

The performance of gas oils from (I) to (VIII), in terms of lubricity, are expressed as machine load (kg) and load carrying capacity (kg/mm$^2$) and are reported the following table.

| Gas Oil No. | Load Carrying Capacity (kg/mm$^2$) | Machine Load (kg) |
|---|---|---|
| I | 173.3 | 30 |
| II | 144.44 | 25 |
| III | 89.65 | 8 |
| IV | 173.3 | 30 |
| V | 173.33 | 30 |
| VI | 202.22 | 35 |
| VII | 115.15 | 20 |
| VIII | 202.22 | 35 |

It should be observed that those gas oils which display L.C.C. (load carrying capacity) values of round 100 kg/cm$^2$ are very likely riskful in terms of failure of mechanical components in diesel engines.

We claim:

1. Gas oil composition for motor vehicles of petroleum or synthetic origin, comprising a gas oil having a sulfur content equal to, or lower than, about 0.2 per cent by weight, a content of aromatic hydrocarbons lower than about 30% by weight, and up to about 10% by volume of ether containing compounds, characterized in that said composition contains, as a lubricity improver agent, from 100 to 10,000 parts per million parts by weight of $C_1$–$C_5$ alkyl esters of a mixture of saturated and unsaturated, straight-chain fatty acids of from $C_{12}$ to $C_{22}$ carbon atoms, derived from vegetable oleaginous seeds.

2. Composition according to claim 1, characterized in that said alkyl esters of fatty acids are methyl esters.

3. Composition according to claim 1, characterized in that said fatty acid esters are derived from soy bean, rapeseed or sunflower seeds oil.

4. Composition according to claim 1, characterized in that said esters are a mixture of esters of fatty acids with a $C_{12}$–$C_{22}$ straight chain, mainly with an even number of carbon atoms in their molecule, which mixture contains from 5 to 20% by weight of saturated fatty acids, from 70 to 95% by weight of total mono-unsaturated and di-unsaturated fatty acids, and from 0 to 10% by weight of total tri-unsaturated and tetra-unsaturated fatty acids.

5. Composition according to claim 4, characterized in that said saturated fatty acids are lauric acid, palmitic acid and stearic acid and said mono-, di- and tri-unsaturated acids respectively are oleic acid, linoleic acid and linolenic acid.

6. Composition according to claim 1, characterized in that the sulfur content is equal to or less than 0.1% by weight.

7. Composition according to claim 1, characterized in that said lubricity improver is present in an amount of 200 to 1,000 parts per million parts by weight.

* * * * *